US006253685B1

(12) United States Patent
Lohr

(10) Patent No.: US 6,253,685 B1
(45) Date of Patent: Jul. 3, 2001

(54) GUIDE RAIL FOR AUTOMATIC CONTROLLED ROAD VEHICLES

(75) Inventor: Robert Lohr, Hangenbieten (FR)

(73) Assignee: Lohr Industrie, Hangenbieten (FR)

( * ) Notice: Subject to any disclaimer, the term of this patent is extended or adjusted under 35 U.S.C. 154(b) by 0 days.

(21) Appl. No.: 09/331,026

(22) PCT Filed: Dec. 12, 1997

(86) PCT No.: PCT/FR97/02291

§ 371 Date: Jul. 6, 1999

§ 102(e) Date: Jul. 6, 1999

(87) PCT Pub. No.: WO98/27281

PCT Pub. Date: Jun. 25, 1998

(30) Foreign Application Priority Data

Dec. 19, 1996 (FR) ..... 96 15924

(51) Int. Cl.[7] ..... E01B 5/04

(52) U.S. Cl. ..... 104/244; 238/125; 238/122

(58) Field of Search ..... 104/242, 243, 104/244, 245, 246, 247; 238/122, 127, 128, 129, 136, 137, 142, 148

(56) References Cited

U.S. PATENT DOCUMENTS

| | | | | |
|---|---|---|---|---|
| 6,064 | * | 1/1849 | Day | 104/244 |
| 508,480 | * | 11/1893 | Kirchner et al. | 104/244 |
| 527,236 | * | 10/1894 | Granges | 104/244 |
| 2,046,448 | * | 7/1936 | Buigne | 104/244 |
| 3,119,349 | | 1/1964 | Hampton et al. | 104/243 |
| 3,707,125 | * | 12/1972 | Milenkovic et al. | 104/242 |
| 4,779,537 | * | 10/1988 | Hafner et al. | 104/244 |
| 5,758,583 | * | 6/1998 | Lohr | 104/245 |
| 5,842,422 | * | 12/1998 | Biship | 104/246 |
| 5,845,581 | * | 12/1998 | Svensson | 104/244 |
| 6,029,579 | * | 2/2000 | Andre et al. | 104/243 |

FOREIGN PATENT DOCUMENTS

| | | |
|---|---|---|
| 195 07 888 A1 | 9/1995 | (DE) . |
| 0 079 099 A2 | 5/1983 | (EP) . |
| 2 220 396 | 1/1990 | (GB) . |
| 96/17129 | 6/1996 | (WO) . |

* cited by examiner

*Primary Examiner*—Mark T. Le
(74) *Attorney, Agent, or Firm*—Davis & Bujold, P.L.L.C.

(57) ABSTRACT

According to the invention, a guide rail for a transportation vehicle with an upper travel surface and base cushion. The guide rail has an intermediate zone extending from the upper surface to the cushion. In the intermediate zone there is at least one surface forming a pathway for a guide wheel of the transportation vehicle to move along the rail. The guide rail can be used for original guide systems and as a guide rail for other guided transportation systems.

9 Claims, 5 Drawing Sheets

GUIDE RAIL FOR AUTOMATIC CONTROLLED ROAD VEHICLES

FIELD OF THE INVENTION

The invention concerns a guide rail designed for public urban transportation systems.

BACKGROUND OF THE INVENTION

Because space is limited in cities, particularly in the center of older cities, municipalities tend to use automatic, controlled public transportation systems for ground transportation.

Such transportation systems require a minimum of ground space, especially for turning.

Tramways are one such means of transportation, but recently there has been a more widespread use of automatic road vehicles guided by systems with various degrees of complexity, depending primarily on a guide rail which serves as a track for the guide wheels of the control mechanism.

Cities which already have public transportation dependent on roads or rails cannot afford to change their infrastructure, since often they have already made substantial investments in their transportation systems.

This invention proposes a positive solution to the problem of how to use existing structures for other types of transportation, particularly automatic ground transportation.

Patent Application No. DE 195 07 880 filed Mar. 7, 1995 by Société Friedrich REMMERT (priority date Mar. 23, 1994) describes a guided railway travel system.

This system is used in various product storage applications, especially by displacing one or more crane structures.

According to this system, a carriage 1 holding the post 5 of a mobile unit is guided in movement along a rail 2 using supporting wheels 9.

Said supporting wheels move along an upper table in the rail. They support the weight of the carriage and its load. Two pairs of guide wheels (10, 11), front and rear, located on either side of the supporting wheel, move along adjacent pathways formed by the sides of the rail.

The supporting wheels are also surrounded by four lateral, rolling supports which guide the carriage.

The purpose of this invention is to provide a high degree of lateral stability for a heavy unit moving along a single rail.

The upper table portion of the rail is not used for guiding, but rather, exclusively for motion, with the motion being simultaneously guided by guide wheels contacting the lateral pathways.

Thus, motion and guidance along the same rail are inseparably associated and made possible by four guide wheels used in pairs, spaced apart from each other and located on either side of the support wheel, giving the carriage a high degree lateral stability.

SUMMARY OF THE INVENTION

The present invention relates to public urban transportation systems using at least one guide rail, which may or may not be a supporting rail, in which the rail or rails are adapted to be used with a road vehicle guide system which uses a guide device with one or two angled guide wheels moving along at least said one rail.

Accordingly, the general goal of the invention is to transform existing rails and adapt them to function as guide rails for another system, specifically a system using an automatic vehicle with angled guide wheels.

A more specific goal is to convert the existing rail or rails into multipurpose systems by using the intermediate area between the base and the upper portion for a different guide system, i.e., a system using angled guide wheels.

To achieve this, the invention relates to a guide rail with an upper pathway and a cushion for attachment to the ground or to a support, characterized in that in an intermediate zone extending from the upper pathway to the attaching cushion, there is at least one pathway along the rail accommodating the guide wheel.

The following features of the invention are of interest:

Modifying an existing rail or rails makes them dual-purpose or multipurpose rails, that is, they can be used for a single guided system or auxiliary systems.

The same infrastructure can serve simultaneously for the original transportation system and other systems.

It can be adapted to two types of automatic guided systems using different control means.

Most important, if it is a railway system, it can be adapted to use with an automatically guided road vehicle.

With a single investment, the guide rail according to the invention ensures future compatibility with other guided railway transportation systems.

The upper portion of the rail is conventionally used as a guide means.

The goal of the invention is to convert this rail to a multi-purpose rail utilizing the other available areas for a different guide wheel system.

A complementary interface is added to the intermediate portion of the rail to allow the use of a different guide system.

The general inventive concept consists of adapting the track to different types of guide systems, without, however, modifying the upper portion of the rail relative to guided movement or simple movement.

BRIEF DESCRIPTION OF THE DRAWING(S) AND

Other characteristics and advantages of the invention will be apparent from the following description, given by way of example, and the accompanying drawings, in which.

DESCRIPTION OF THE PREFERRED EMBODIMENT(S)

Figure 2:
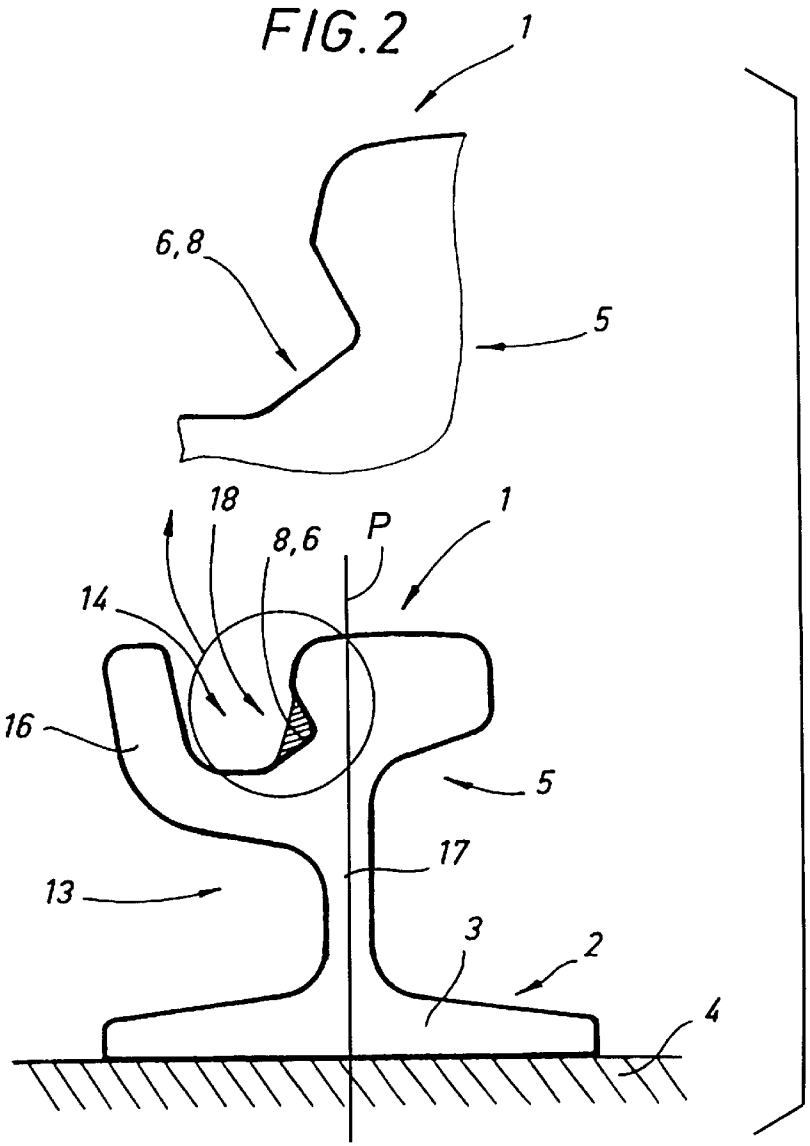
FIG. 2 depicts a vertical section of a second guide rail according to the invention with the guide ramp enlarged.
Figure 1:
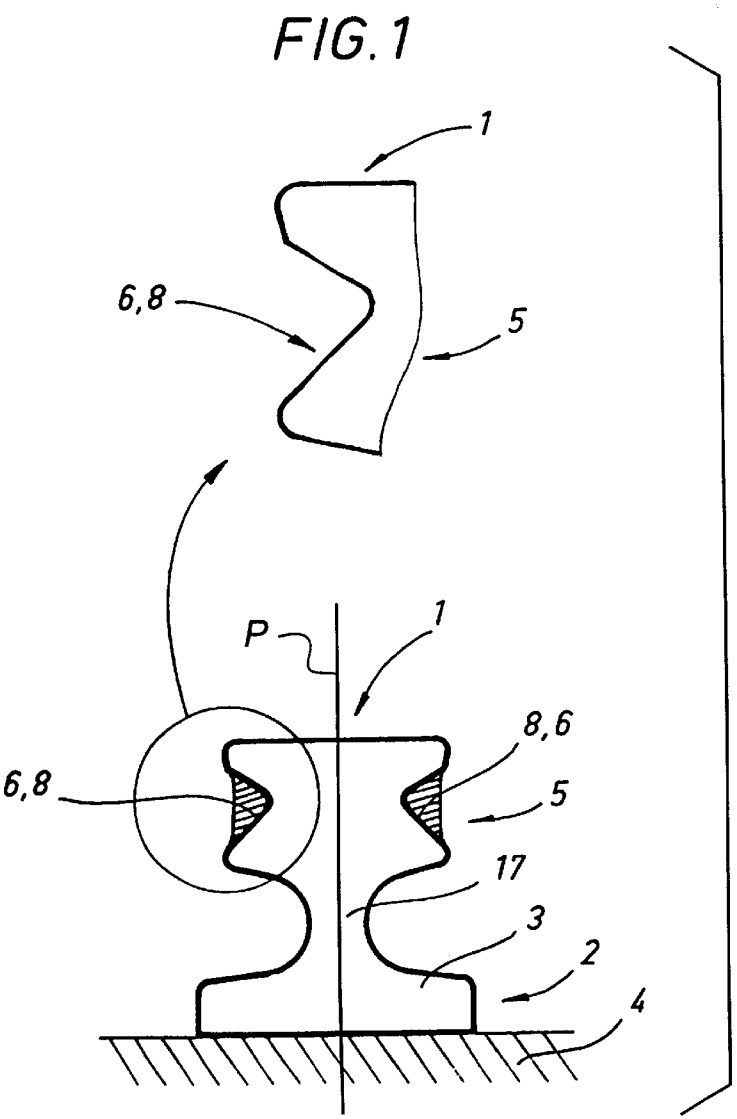
FIG. 1 depicts a vertical section of a first guide rail according to the invention with the guide ramp enlarged.
Figure 3:
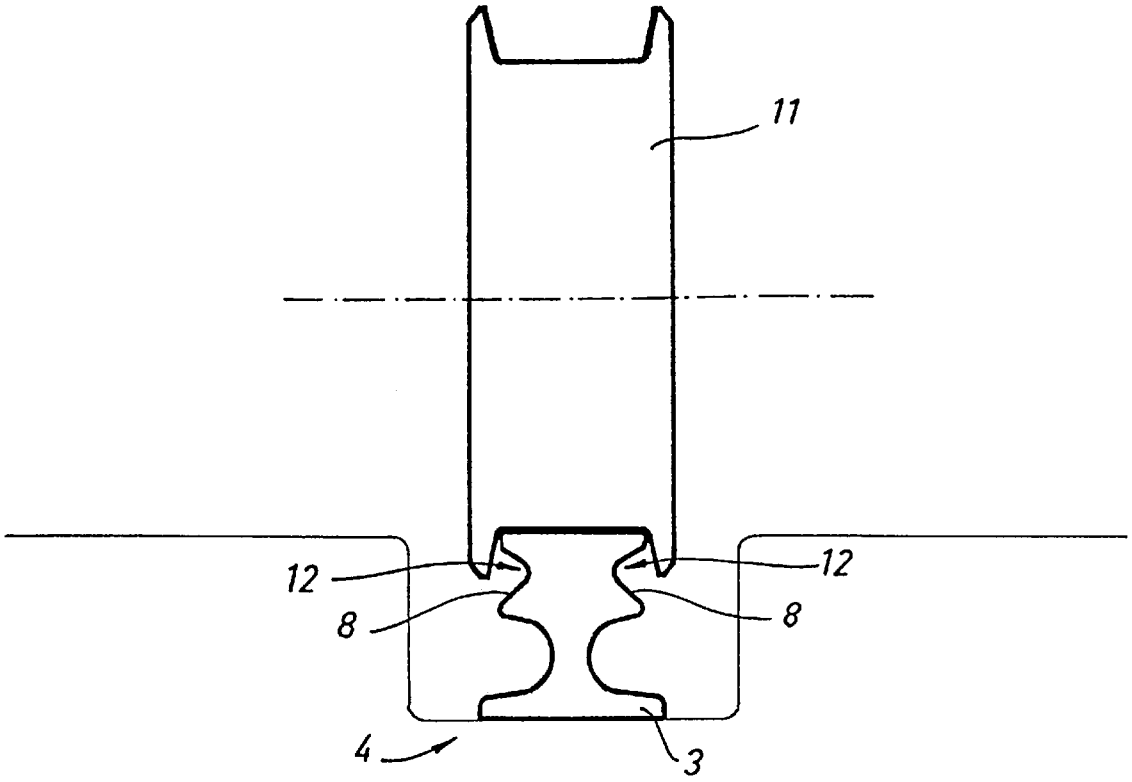
FIGS. 3 and 4 are transverse cross-sections showing the first guide rail used with systems having one straight guide wheel and two angled guide wheels, respectively.
Figure 4:
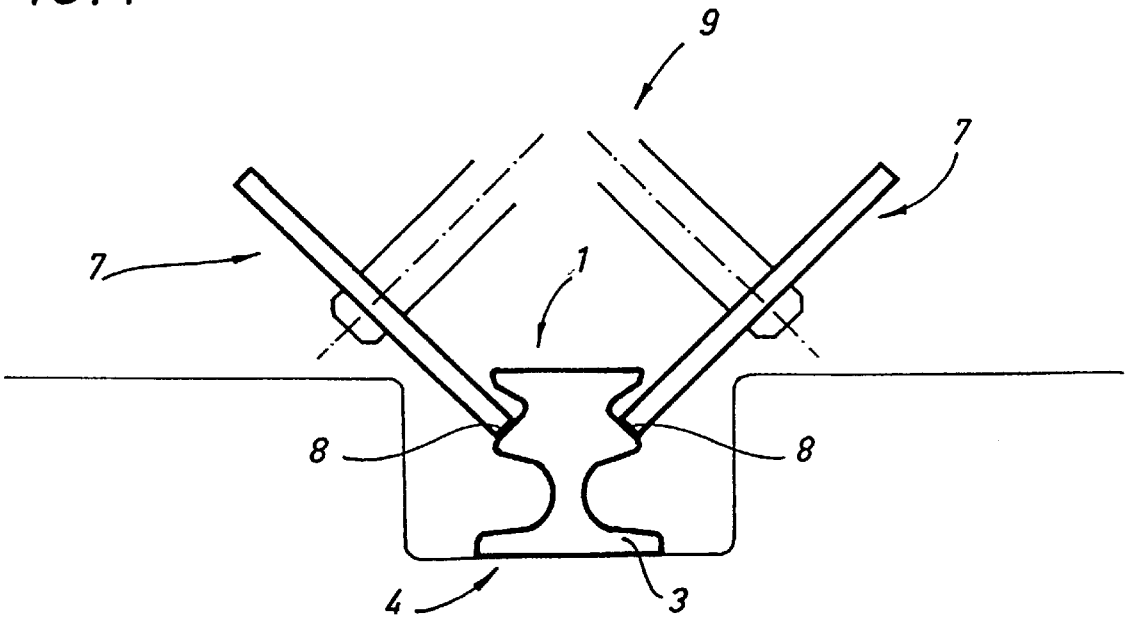
Figure 5:
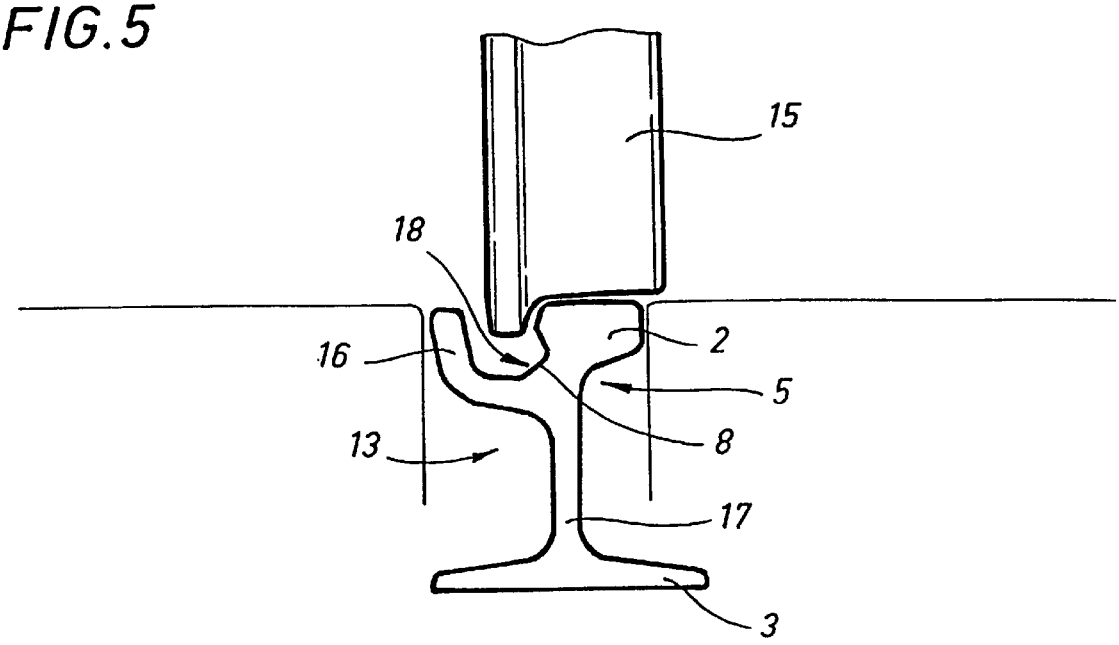
FIGS. 5 and 6 are transverse cross-sections showing the second variation of the guide wheel of the invention used for guided travel along the rail and with an angled guide wheel, respectively.
Figure 6:
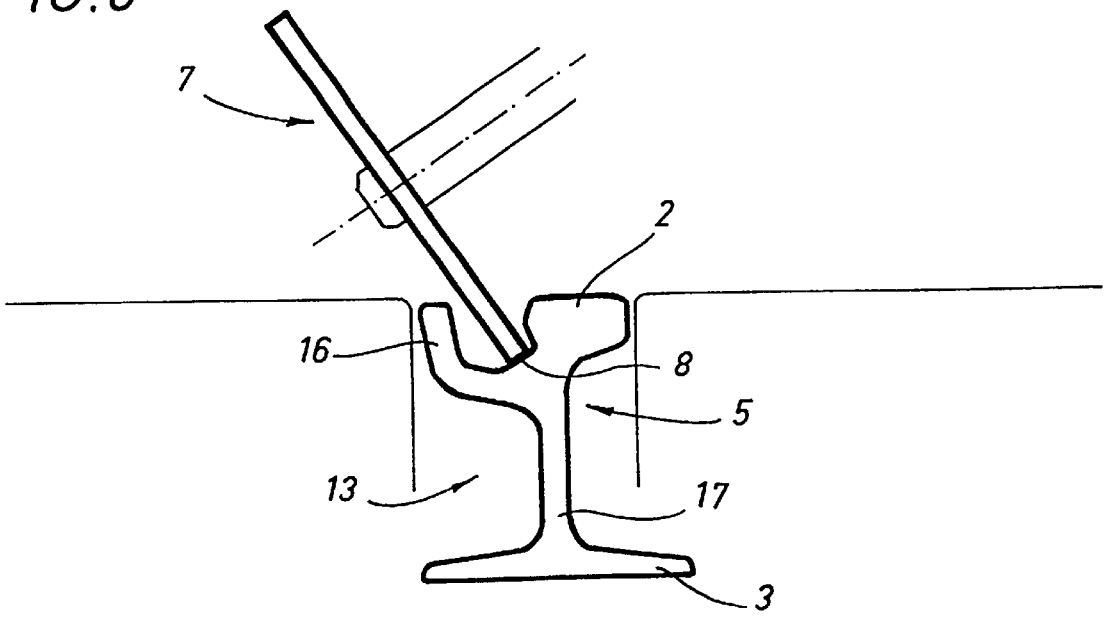

On a guide rail which conventionally comprises an upper travel surface 1 or table and a base 2 forming a contact cushion 3 for attachment to the ground 4 or to a flat support, on intermediate zone 5 extending from upper portion 1 to base 2, there is at least one surface 6 along which at least one guide wheel 7 is displaced along the rail.

This travel path 6 preferably forms an inclined ramp 8 located in the side of the rail in intermediate zone 5 defined below, which is the recessed area shown by cross-hatching.

Figure 7:
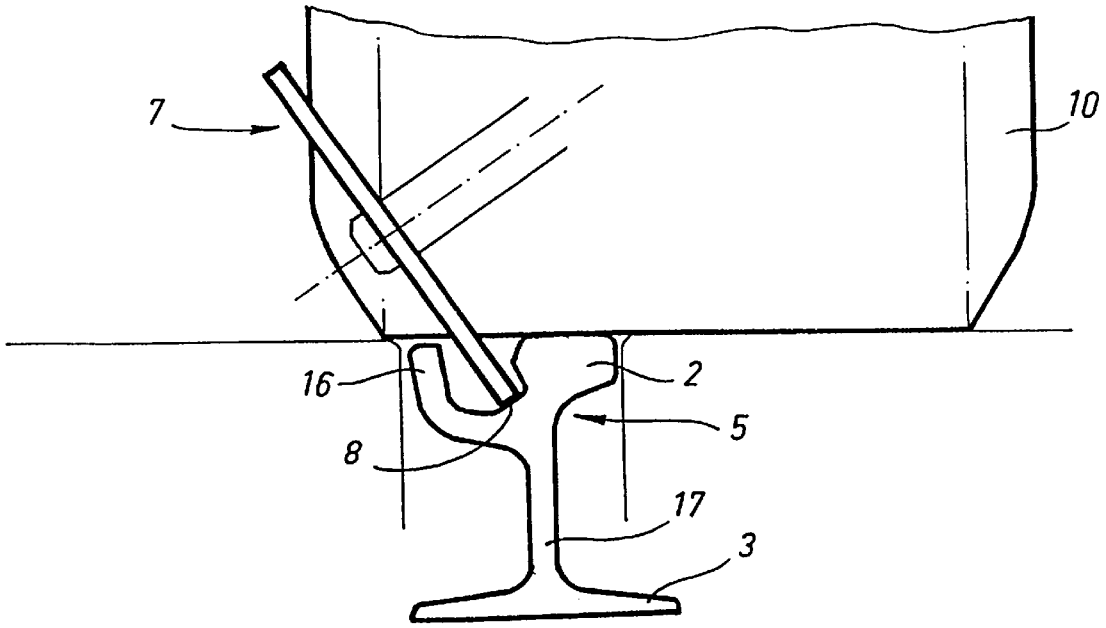
FIG. 7 shows the guide unit with one angled guide wheel and the rear of the adjacent tire of the controlled vehicle.
Figure 9:
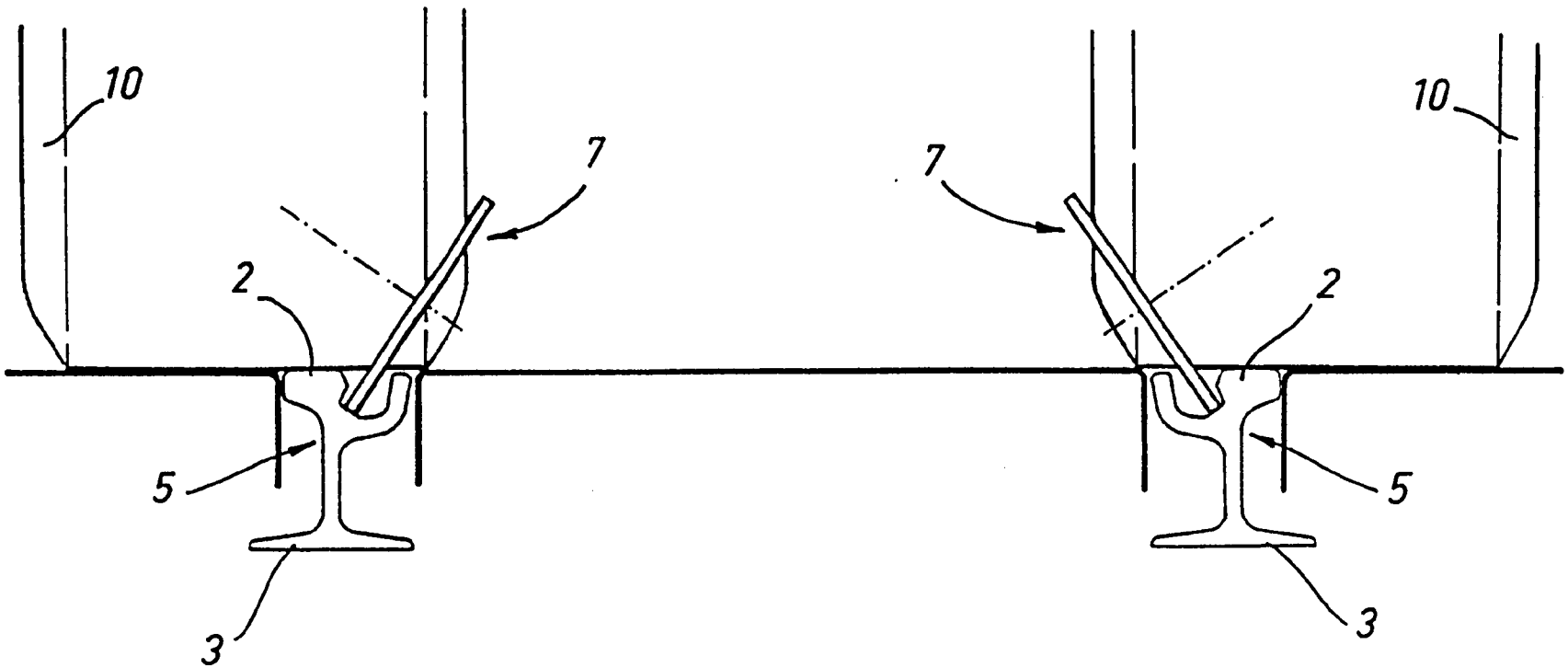

The ramp cooperates with an angled guide wheel 7 forming part of the guide system 9 mounted on a road vehicle, one wheel of which is shown with its tire 10 in FIGS. 7 and 9.

This pathway can be placed vertically to cooperate with a horizontal guide wheel. It could also be horizontal to cooperate with a vertical guide wheel.

By way of example, two types of rail section are shown.

The first is a rail section with the upper portion used in the conventional way to guide a wheel 11, with a pulley-type wheel having a square or rectangular groove. The lateral walls of the groove are designed to eliminate the risk of derailment.

The intermediate zone of this guide rail consists of the lower portion of the rail head, followed by the web. It has generally angular notches on either side 12 which form a ramp 8 serving as tracks for guide wheel 7. This is part of a particular guide system 9 that is different from the system with a straight upper wheel.

The ramp is inclined along a slope parallel to the axis of the guide wheel. The intermediate web portion defines a central longitudinal plane P which extends through the guide rail.

The second variation is in the general form of a rail 13 with a groove 14 such as those used for conventional urban rail systems known as tramways.

It consists of an upper travel-guide rail head 1, generally called a travel surface, used for wheels or tramway wheels 15. The lateral portion of rail head is followed laterally by a transverse linear extension 16 defining, along with the rail head, longitudinal groove 14. The lower portion of the rail head is followed by a web 17 and attaching cushion 3.

According to the invention, the upper portion 1 which serves as a travel surface remains identical, while intermediate portion 5 located below the rail head beside web 17 is a recessed area 18 incorporating ramp 8, preferably inclined, and providing a pathway for guide wheel 7.

Figure 8:
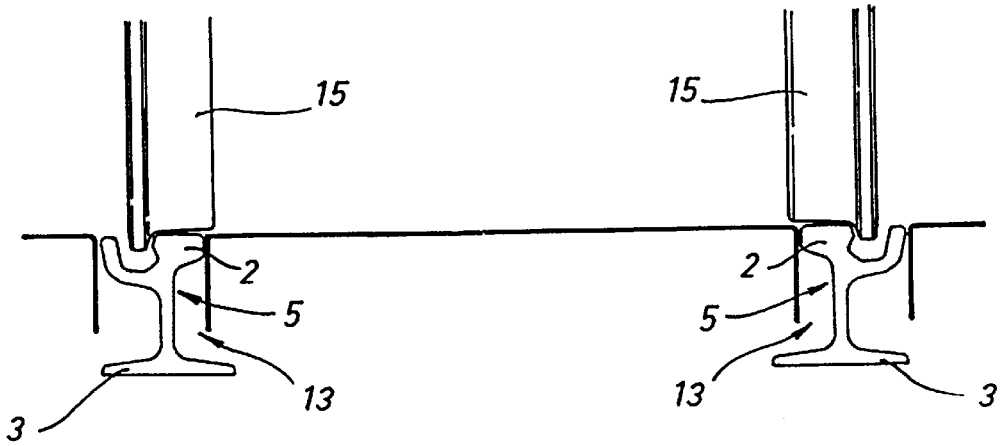
FIGS. 8 and 9 are vertical sections, respectively, of a complete unit with two guided travel rails and a complete unit with two angled guide wheels shown in front of the adjacent tire of the controlled vehicle.

These rails are generally utilized in pairs (FIGS. 8 and 9). The facing single rail is symmetrical to the longitudinal median axis of the track. It has the same features, enabling it to function as a pathway for symmetrical guide wheel 7 of a similar guide system on a road vehicle.

The guide wheels on said similar system are angled and diverge from the top to the bottom. They can each be integrated within a guide arm forming part of a single unit.

In any type of guide system, the upper portion of the rail can be used to conduct current through a contact integrated within the vehicle.

What is claimed is:

1. A guide rail for guiding a guide wheel of a rail guided vehicle, the guide rail comprising:

an upper flange having a substantially horizontal top bearing surface (1) and a lower surface and first and second opposed side surfaces, a bottom flange (2) having an upper surface and a substantially horizontal base surface (3) for attaching the guide rail to a rail support surface (4), and an intermediate web portion connecting the lower surface of the upper flange to the upper surface of the bottom flange (2), the intermediate web portion defining a longitudinal plane extending longitudinally through the guide rail;

wherein the upper flange further comprises at least one intermediate guide surface formed in the upper flange and constituting a major portion of a respective one of said side surfaces between the top bearing surface (1) and the lower surface of the upper flange, the intermediate guide surface comprising an upper region and a lower region converging from a spaced apart upper and lower ends of the intermediate guide surface towards a common endpoint located between the upper and lower ends and the longitudinal plane extending longitudinally through the guide rail.

2. The guide rail according to claim 1 wherein both said upper and lower ends of the upper and lower converging regions are vertically spaced apart along one of said first and second opposed sides surfaces of the upper flange, the upper and lower regions converging towards the longitudinal plane to form a substantially horizontally aligned V-shaped groove in one of said opposed side surfaces of the upper flange.

3. The guide rail as set forth in claim 2, wherein the intermediate guide surface engages a corresponding contact surface of the guide wheel when engaged with the guide rail.

4. The guide rail as set forth in claim 3, wherein the contact surface of the guide wheel is substantially supported by the lower region of the intermediate guide surface.

5. The guide rail according to claim 1, wherein the upper and lower regions of the intermediate guide surface (6) form a substantially acute angle with respect to the common end point located between the upper and lower ends and the longitudinal plane defined by the intermediate web.

6. The guide rail according to claim 5, wherein the upper and lower ends of the upper and lower regions of the intermediate guide surface (6) define a longitudinal planar opening substantially parallel with the longitudinal plane defined by the intermediate web.

7. The guide rail according to claim 1, wherein said at least one intermediate guide surface includes, a first intermediate guide surface (6), formed in the first side of the upper flange and a second intermediate guide surface, formed in the second side of the upper flange.

8. The guide rail according to claim 7 wherein and the intermediate guiding surfaces (6) facilitate guidably engaging opposed contact surfaces of a pair of guide wheels (7).

9. A guide rail for guiding a guide wheel of a rail guided vehicle, the guide rail comprising:

an upper flange having a substantially horizontal top bearing surface (1) and a lower surface and first and second opposed side surfaces, a bottom flange (2) having an upper surface and a substantially horizontal base surface (3) for attaching the guide rail to a rail support surface (4); and an intermediate web portion connecting the lower surface of the upper flange to the upper surface of the bottom flange (2), the intermediate web portion defining a longitudinal plane extending longitudinally through the guide rail; and wherein the upper flange further comprises an intermediate V-shaped guide groove formed in the upper flange and constituting a major portion of a respective one of said side surfaces between the top bearing surface (1) and the lower surface of the upper flange, the intermediate V-shaped guide groove defined by an upper region, located adjacent the top bearing surface, and a lower region, located adjacent the lower surface of the upper flange, the upper and lower regions converging with one another to a common vertex, and the common vertex is located adjacent to the longitudinal plane extending longitudinally through the guide rail.

* * * * *